United States Patent [19]

Masuda et al.

[11] Patent Number: 4,747,790

[45] Date of Patent: May 31, 1988

[54] CONNECTOR FOR PRINTED CIRCUIT BOARD

[75] Inventors: Toru Masuda, Osaka; Norio Ichitsubo, Yao, both of Japan

[73] Assignee: Hosiden Electronics Co., Ltd., Osaka, Japan

[21] Appl. No.: 873,663

[22] Filed: Jun. 12, 1986

[30] Foreign Application Priority Data

Jul. 18, 1985 [JP] Japan ..... 60-110147[U]
Oct. 16, 1985 [JP] Japan ..... 60-158005[U]

[51] Int. Cl.[4] ..... H01R 9/09

[52] U.S. Cl. ..... 439/631; 439/60; 439/61; 439/326

[58] Field of Search ..... 339/17 L, 74 R, 75 MP, 339/91 R, 176 R, 176 MP, 176 MF, 206 R, 220, 255; 439/59-62, 325-328, 629-637

[56] References Cited

U.S. PATENT DOCUMENTS 3,778,753 12/1973 Occhipinti et al. ..... 439/631
3,795,888 3/1974 Nardo et al. ..... 339/17.2 X
3,920,303 11/1975 Pittman et al. ..... 339/176 MP X
4,084,874 4/1978 Georgopulos ..... 339/75 MP
4,136,917 1/1979 Then et al. ..... 339/17 L
4,501,465 2/1985 Hoshino et al. ..... 339/206 R X
4,575,172 3/1986 Walse et al. ..... 339/176 MP X

*Primary Examiner*—John McQuade
*Attorney, Agent, or Firm*—Jones, Tullar & Cooper

[57] ABSTRACT

The invention discloses a connector for printed circuit board comprising a first contact piece with a spring contactor, a second contact piece with a spring contactor, and a body in which these spring contactors can be arranged at their positions deviated from each other in lengthwise direction and a printed circuit board can be inserted in and out obliquely between contact points of the spring contactors, characterized in that when the printed circuit board inserted obliquely in the body is situated in substantially horizontal state, the printed circuit board is tightly contacted with the contact points of the spring contactors, thereby electrical connection between the printed circuit board and the first and second contact pieces being exactly and appropriately insured over a long period irrespective of frequency in insertion in and out of the printed circuit board.

5 Claims, 14 Drawing Sheets

CONNECTOR FOR PRINTED CIRCUIT BOARD

BACKGROUND OF THE INVENTION

The present invention relates to a connector suited for connecting a printed circuit board to make electrically conductive connection, and more particularly to a connector for electrical connection of a printed circuit board incorporated in a game cartridge which is frequently inserted in and out for use in a video game machine, for example.

Recently, the video game has come to be very popular among not only children but also grown-ups, and this kind of TV game set usually comprises a main part to be connected with a TV receiver having a computer built-in, a game cartridge to be inserted into the main part, and a control unit. The game cartridge comprises a printed circuit board with a ROM (Read Only Memory) having various kinds of software programs for the game stored therein, and one side of the printed circuit board is exposed to the outside forming a package for connection. Consequently by providing an electrical connection between these two printed circuit boards, i.e., one for the game cartridge, and the other for the main printed circuit board on the computer incorporated in the main part, the game operation is feasible. For the connection of these two printed circuit boards, a cartridge type connector as shown in FIG. 18 is generally used.

This known connector has a construction in which one end of a couple of elastic slips of conductors 101, 102 is connected electrically by soldering with the main printed circuit board 103 incorporated in the computer, while the other end thereof is bent to form spring portions 101*a*, 102*a*, and at the same time contact points 101*b*, 102*b* are formed at the locations where the spring portions 101*a*, 102*b* face each other at the shortest distance. The couple of contact points 101*b*, 102*b* are so arranged as to face each other at the deeper side of the connector inlet 104 with smaller spacing than the thickness of the printed circuit board of the cartridge. Thus, by inserting the printed circuit board 105 of the cartridge into the gap between contactors 101*b*, 102*b*, both spring parts 101*a*, 102*a* are expanded to the outside as shown by the arrow, and by the elasticity preserved between both spring parts 101*a*, 102*a*, both contactors 101*b*, 102*b* are depressed on the circuitry pattern of the printed circuit board 105 to connect electrically the two printed circuit boards 103, 105 with each other.

By the way, since the game cartridge is inserted in when it is used and taken out when it is not used, the pair of contact points 101*b*, 102*b* are quite frequently connected and disconnected. They are supposed to be engaged more than twenty to thirty thousand times, i.e., more than twenty to thirty thousand repetitions of insertion in and out. Consequently, a specific design should be given on the spring parts 101*a* and 102*a* so as to be adequately endurable to the stress incurred by the deformation due to insertion of the printed circuit board 105. That is to say, the spring parts 101*a*, 102*a* are required to be provided with a considerable amount of preload beforehand. For that purpose, it is inevitable that expensive spring materials of high performance are used for the conductor slips 101, 102, and the thickness of the platings applied on the contact points 101*b*, and 102*b* shall be also comparatively large resulting in cost increase of the connector. Moreover, it is unavoidable that, in spite of the expensive materials as mentioned above being incorporated in the construction, too frequent repetitions of insertions in and out cause peeling off of the circuitry pattern on the printed circuit board 105, or troubles such as those caused by improper electric connection due to deterioration incurred on the spring parts 101*a*, 101*b*, affecting negatively on durability of the contactor, accompanied with some inconvenience in operation of insertion requiring some excessive force.

In order to solve the above mentioned problems, a connector as shown in FIG. 19 has been proposed, for example. This connector is provided with a couple of conductive slips 206, 207 on the female contact side, which are respectively formed into meanderingly curved three contact points 206*a*, 206*b*, 206*c*, and 207*a*, 207*b*, 207*c*, respectively and further provided with a rotatable expander member 208 of substantially elliptic form between the conductive slips 206, 207 so that, as shown by the solid line in the drawing, the printed circuit board 205 may be positioned as shown by the solid line in the drawing prior to the insertion thereof. Then both of the conductive slips 206, 207 are expanded outward by this expander member 208, letting the printed circuit board 205 be inserted, and thereafter the expander member 208 is rotated by an angle of 90° as shown by one dot chain line in the drawing so as to let each of the contact points 206*a*, 206*b*, 206*c*, and 207*a*, 207*b*, 207*c* be depressed on the printed circuit board 205.

Taking the above construction, it is feasible to protect the circuitry pattern and contacts from deterioration due to friction by eliminating the sliding of contacting points 206*a*, 206*b*, 206*c*, and 207*a*, 207*b*, 207*c* at the time of insertion in and out of the printed circuit board 205. On the other hand, such construction needs unavoidably incorporation of various members and materials such as expander member 208, controlling unit, etc., not only resulting in a considerably complicated construction but also in an expensive connector. Besides, the operation of the expander part 208 is involved with considerably troublesome operation since precise rotational operation of the expander part 208 is necessary.

SUMMARY OF THE INVENTION

Accordingly, an object of this invention is to provide a connector for printed circuit board enabling exact electrical connection between a female contact side and a printed circuit board by quite simple insertion in and out operation, irrespective of frequency in use. The foregoing object of this invention is accomplished by providing a connector characterized in that a couple of spring contactors' contacting points on the female contact side which are arranged facing each other with a specified spacing are located in front and back of a printed circuit board so as to be inserted-in and out from an oblique stance.

DESCRIPTION OF THE PREFERRED EMBODIMENTS

Figure 1:
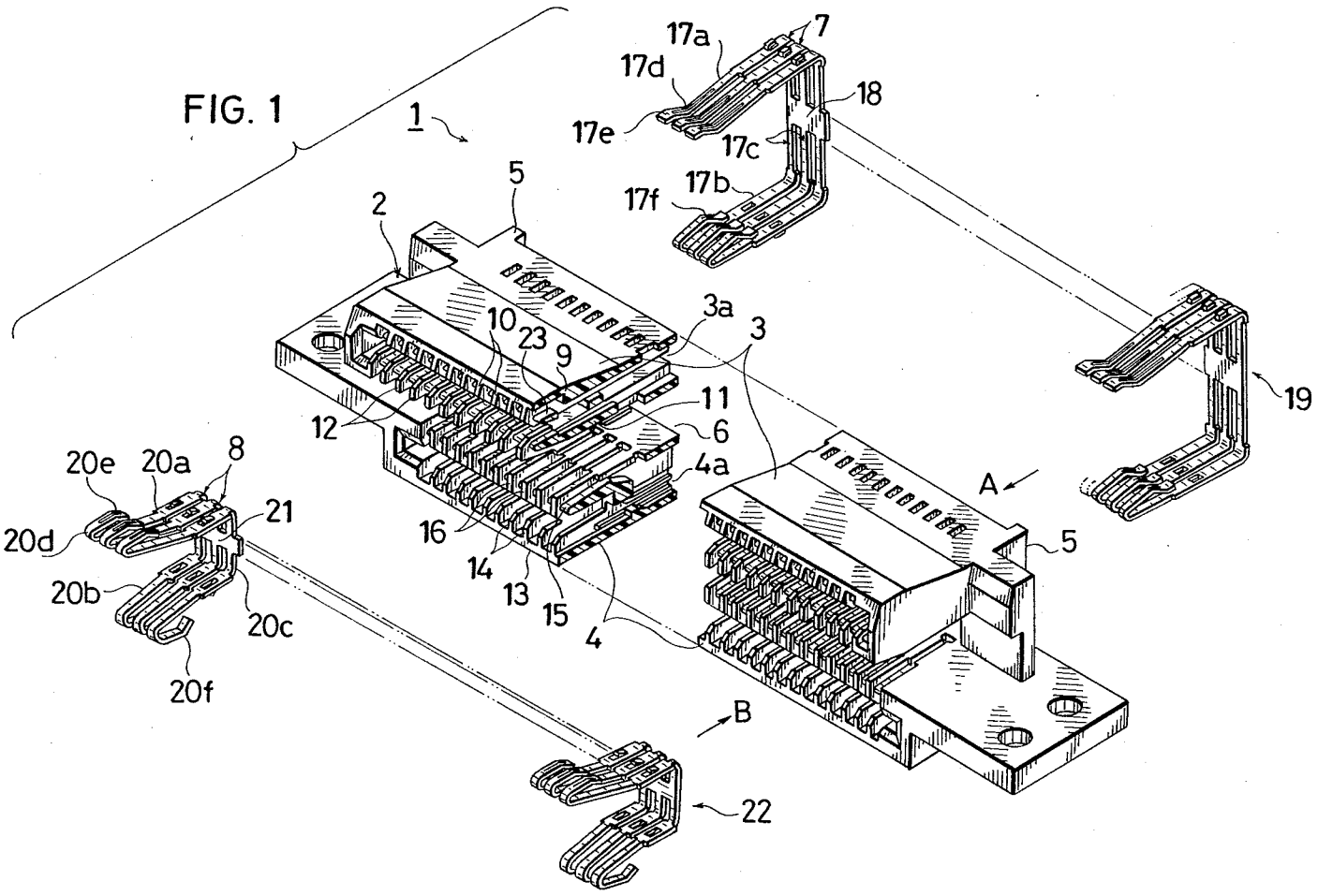
FIG. 1 is a partially exploded perspective view of a connector which is an embodiment of the invention.
Figure 2:
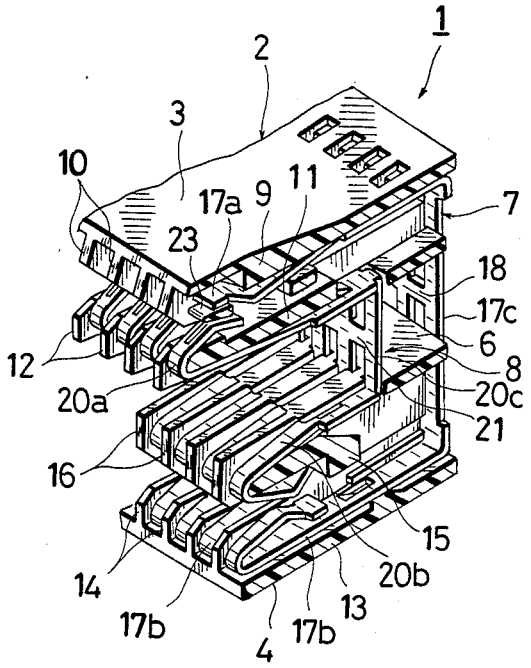
FIG. 2 is an partial perspective view of an internal construction of said connector.
Figure 3:
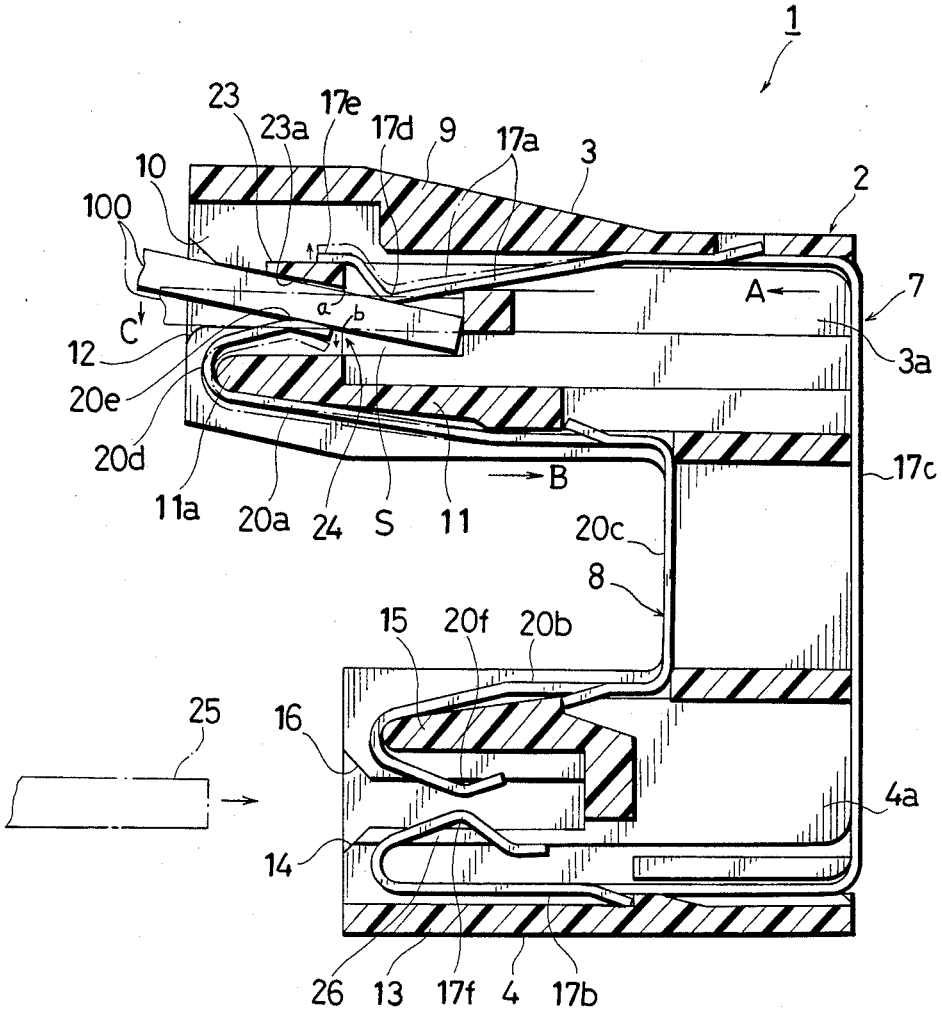
FIG. 3 is an enlarged sectional view of said connector.

In FIG. 1 showing an exploded view of a connector partially cut-off, FIG. 2 showing a broken perspective view of the internal construction of the connector, and FIG. 3 showing an enlarged sectional view of the connector, reference numeral 1 denotes a connector of which body 2 is made of plastic resin formed in a C or lateral U shape. The body 2 has an upper body portion 3 and a lower body portion 4. A rear end of the upper body portion 3 and a rear end of the lower body portion 4 are solidly formed into one part by side walls 5, 5. A printed circuit board is inserted through one side of the upper body portion 3 and another printed circuit board is inserted through one side of the lower body portion 4. An opening 6 is formed between the upper body portion 3 and the lower body portion 4. The opening 6 extends from the back face of the body 2 toward the front face thereof and penetrates through the side walls 5, 5 in the direction from front to back (See FIGS. 1 and 3). A first contact piece 7 of a first contact piece group 19 which is C or laterally U shaped for insertion from the back face of body 2 in the direction of the arrow A (FIG. 3), and a second contact piece 8 of a second contact group 22 which is also C or laterally U shaped for insertion from the front face of body 2 in the direction of arrow B (FIG. 3) are provided, respectively. That is to say, as shown in FIG 3, the spring contactor insertion inlets 3*a*, 4*a* are respectively formed on the back face sides of the upper body portion 3 and the lower body portion 4. On the lower face of a top wall 9 of the upper body portion 3, there are a number of partition walls 10 each provided with a specified distance in the lateral direction of the body 2, and on the bottom wall 11, a number of partition walls 12 are also provided in a like manner each at a specified distance. On the lower wall 13 and on a top wall 15 of the lower body portion 4, there are also provided a number of partition walls 14, 16 also each at a specified distance in the lateral direction of width of the body 2. The distance between the individual partition walls 10, 12, 14 and 16 is specified to be equal so that they are all in conformity with each other in the vertical direction.

In the first contact piece 7, connecting pieces 17*c* are solidly built into a body for connection of first upper and lower spring contactors 17*a*, 17*b* at their rear end portion, and a number of these connecting pieces 17*c* are connected together through a tie bar 18 forming a parallel arrangement. The first upper and lower spring contactors 17*a* and 17*b* of the first contact pieces 7 of the first contact piece group 19 are inserted respectively through contactor inlets 3*a*, 4*a* in the direction of the arrow A shown in FIG. 1 and FIG. 3 to be arranged between the adjacent partition walls 10, 10 and 14, 14.

Second contact pieces 8 are smaller than the first contact pieces 7, and connecting pieces 20*c* are solidly built into a body for connection of second upper and lower spring contactors 20*a*, 20*b* and their end portions. These connecting pieces 20*c* are connected together through a tie bar 21 forming a parallel arrangement. By inserting the second upper and lower spring contactors 20*a* and 20*b* of second the second contact pieces 8 of the contact piece group 22 from the front side of the body 2 (in the direction of arrow B in FIG. 1) the second spring contactors 20*a*, 20*b* of the second contact pieces 8 are arranged inside the space between adjacent pairs of partition walls 12, 12, and 16, 16 respectively as shown in FIG. 2 and FIG. 3.

In this way, by incorporating the first contact piece group 19 and the second contact piece group 22 into the body 2, each of the connecting tie bars 18 and 21 are arranged in the opening 6, and the connecting tie bar 18 of the first contact piece group 19 is arranged on the rear side of the connecting tie bar 21 of the second contact piece group 22.

On the other hand, a space S is formed between the opposed walls 9, 11, on the upper side of the body 2, as shown in FIG. 3. Near the upper wall 9 which is one of the walls forming this space S, the first upper spring contactor 17*a* is disposed. This first upper spring contactor 17*a* is bent to form a V-shape and the top part of the portion serves as the first contacting point 17*d*. The front end 17*e* of the first upper spring contactor 17*a* is held in contact with the outer face, (i.e., the upper face shown in the drawing) of a locking piece 23 which is provided between adjacent partition walls 10 and near the opening of the space S. In this connection, the inner face (i.e., the lower face in the drawing) of this locking piece 23 is slanted upward so as to form a guide face 23*a* facilitating proper insertion in and out of a printed circuit board 100 in an oblique direction.

Further, the second upper spring contactor 20*a* of the second contact piece 8 is arranged in contact with the outer face, (i.e., the lower face in the drawing of the lower wall 11, which is the other side of the wall). This second upper spring contactor 20*a* is provided with a laterally U-shaped part 20*d* in the front end portion, which is externally fitted with a front end 11*a* of the lower wall 11, and a V-shaped bent portion on the front end of the U shaped part 20d is projected into the space S. At top end of the bent portion serves as a second contacting point 20e.

In addition, the first contacting point 17d is arranged with a little deviation backward from the second contacting point 20e i.e., toward the back face of the body 2 so that the printed circuit board 100 can be inserted in and out obliquelly between the contacting points 17d and 20e. A female contact 24 is formed by the first upper spring contactor 17a and the second upper spring contactor 20a.

On the other hand, the first lower spring contactor 17b formed by bending a lower side end of the first contact piece 7 and the second lower spring contactor 20b formed by bending a lower side end of the second contact piece 8 are arranged in the lower body portion 4. Further, a contacting point 17f of the first lower spring contactor 17b and a contacting point 20f of the second lower spring contactor 20b are arranged to face each other with a spacing narrower than the thickness of the main printed circuit board 25. Since the main printed circuit board 25 is almost invariably held inserted between the contacting points 17f, 20f and is not inserted in and out so frequently, there is no inconvenience involved at all, even if a female contact 26 is formed by the first lower spring contactor 17b and the second lower spring contactor 20b.

Besides, according to connector 1 described above, the two female contacts 24 and 26 can be formed at the same time.

Figure 4A:
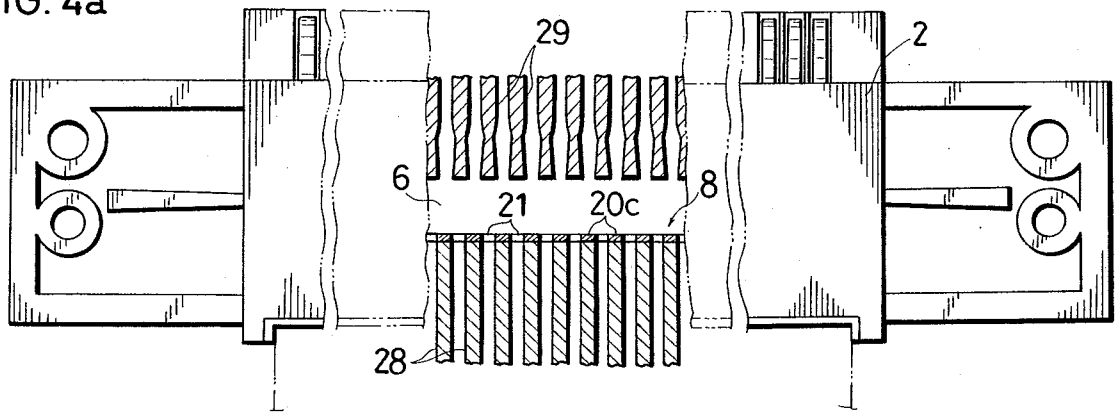
FIG. 4*a* through FIG. 4*d* are views illustrating sequential procedure of punching a tie bar out in order.
Figure 4B:
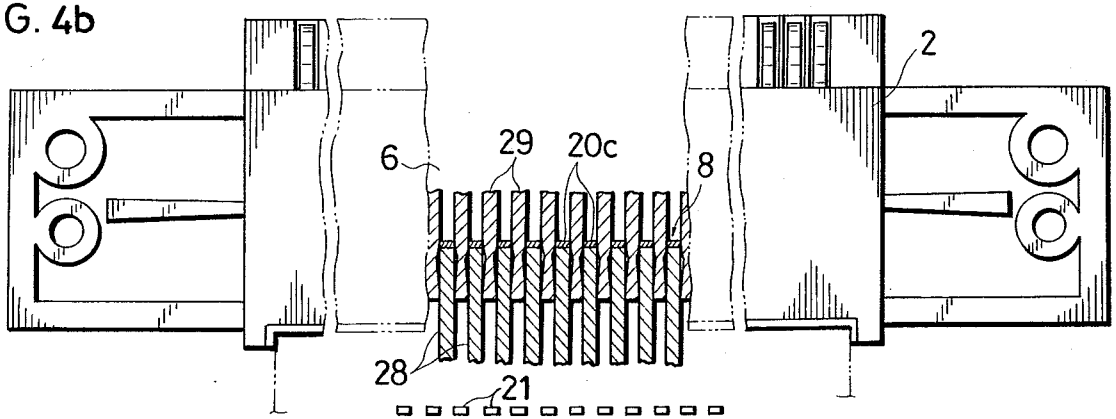
Figure 4C:
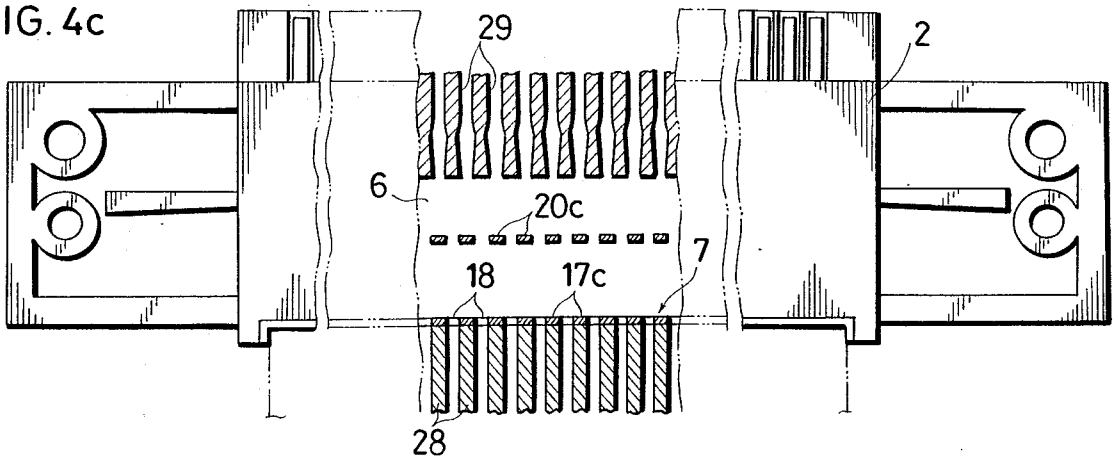
Figure 4D:
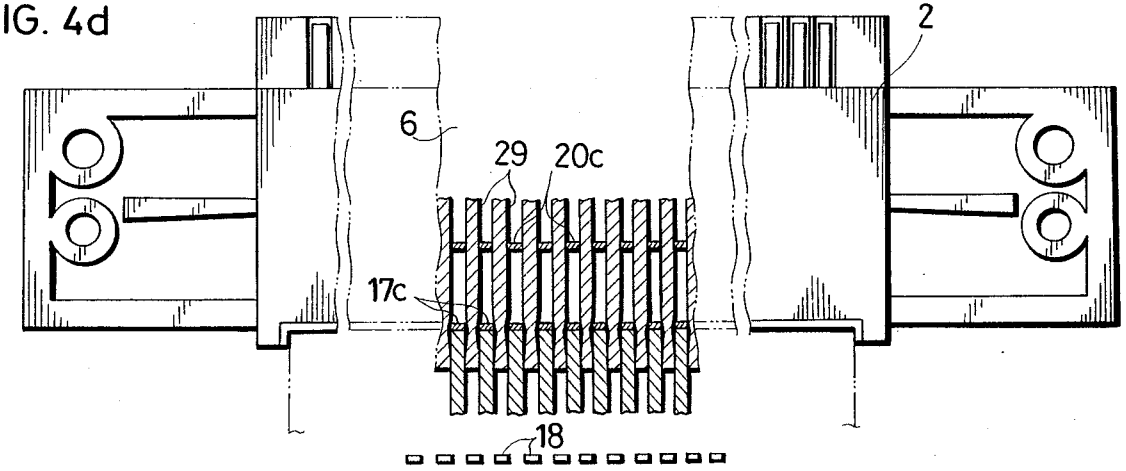

The first and second contact piece groups 19 and 22 can be divided into the first contact piece 7 and the second contact piece 8 cutting off tie bars 18 and 21. FIG. 4a through FIG. 4d give the sequential procedures of cutting off the tie bars 18 and 21, and in which, first, a receiving die 28 is applied to the rear face of the connecting piece 20c of the contact piece 8 so as to punch out the tie bar 21 as shown in FIG. 4b by operating a punch 29, each punching edge of which is Π-shaped, toward the opening 6. Then, as shown in FIG. 4c, the receiving die 28 is applied to the rear face of the connecting piece 17c of the first contact piece 7, directing the punch 29 toward the opening 6 as shown in FIG. 4d, and the punch 29 is operated through the space between the connecting pieces 20c of the second contact piece 8 of which tie bar 21 was already punched out before punching out the tie bar 18.

In the case of the embodiment described above with reference to FIG. 4a to FIG. 4d, the punching is carried out in the procedure wherein after punching out the tie bar 21 of the second contact piece 8, the first contact piece 7 is incorporated in the body 2, and thereafter the tie bar 18 of the first contact piece 7 is punched out. The punching out of the tie bars 21 and 18 can be reversed in the sequential order of the punching procedures, however. That is to say, by reversing the arrangement of the punch 29 and receiving die 28, the tie bar 21 of the second contact piece 8 may be punched out after punching out the tie bar 18 of the first contact piece 7.

Figure 5:
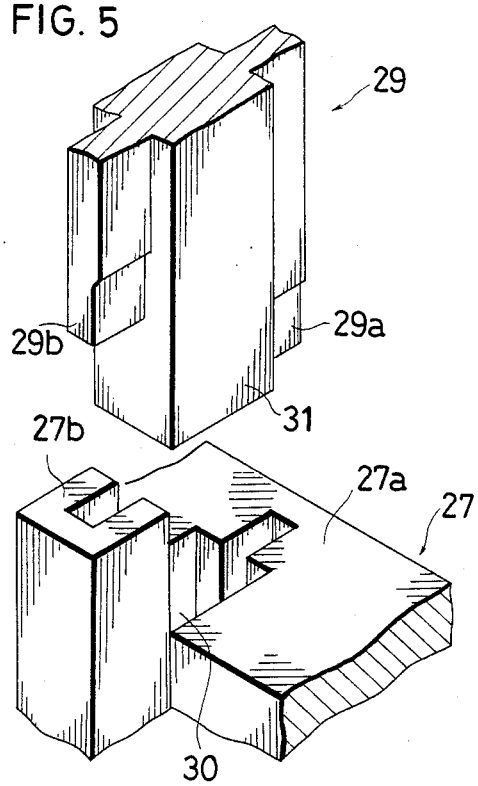
FIG. 5 is a partial perspective view of a metal punch die to be used for tie bar punch out.
Figure 6:
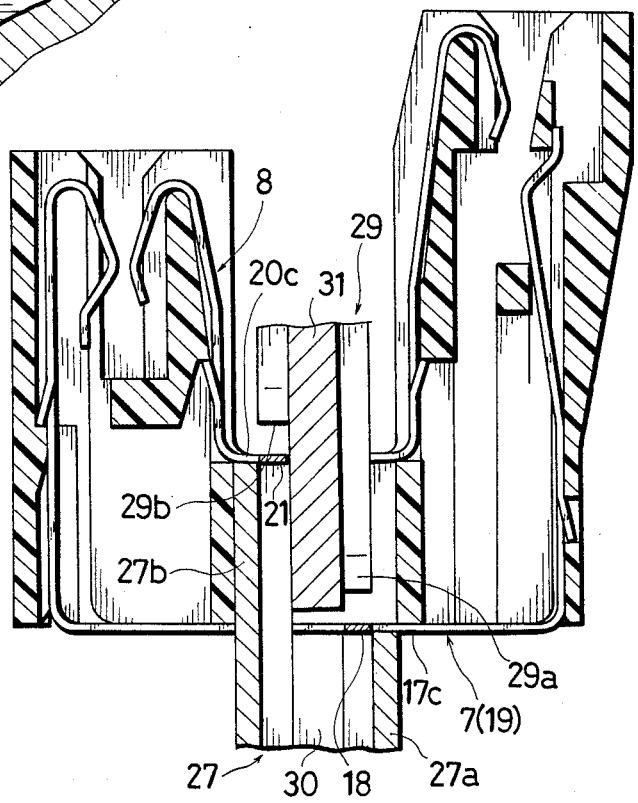
FIG. 6 is a sectional view illustrating a status of usage of the metal punch die given in FIG. 5.

It is further possible to punch out the tie bars 21 and 18 at the same time by shifting vertically locations of the tie bars 21 and 18. In this case, the metal die shown in FIG. 5, as an example, is preferably used. The receiving die 27 of this metal die is provided with a first receiving part 27a and a second receiving part 27b on different levels, the former is applied to the connecting piece 17c of the contact piece 7, while the latter is applied to the connecting piece 20c of the second contact piece 8. The second receiving part 27b can be inserted in and out of the space between connecting piece 17c and 17c of the adjacent first contact pieces 7 and 7. The punch 29 is provided with a first cutting edge part 29a and a second cutting edge part 29b respectively corresponding to the first receiving part 27a and the second receiving part 27b on different levels. Numeral 30 denotes a guide hole which is provided with the receiving die 27, and numeral 31 is a guide part of the punch 29. For punching out of the tie bars 21 and 18 simultaneously, as shown in FIG. 6, starting from the status where the first connecting piece group 19 and the second connecting piece group 22 are inserted into the body 2, the second receiving part 27b of the receiving die 27 is applied to the connecting piece 20c of the second contact piece 8 through the space between the connecting pieces 17c, 17c of the first contact piece 7, and at the same time the first receiving part 27a of the receiving die 27 is applied to the connecting piece 17c of the first contact piece 7. From such a state, the punch 29 is operated toward the opening 6 and punches out the tie bar 18 by the first cutting edge 29a and at the same time the tie bar 21 by the second cutting edge 29b.

Figure 7:
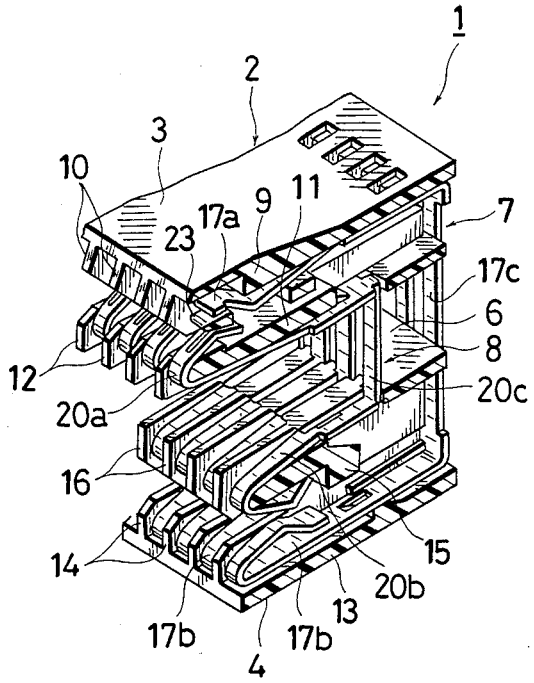
FIG. 7 is a perspective view showing a complete status of a connector.

FIG. 7 shows the connector 1 with the tie bars 18 and 12 punched out in the manner mentioned above.

Described hereunder is a cassette loading/unloading device for a video game, in which the connector 1 is incorporated.

Figure 8:
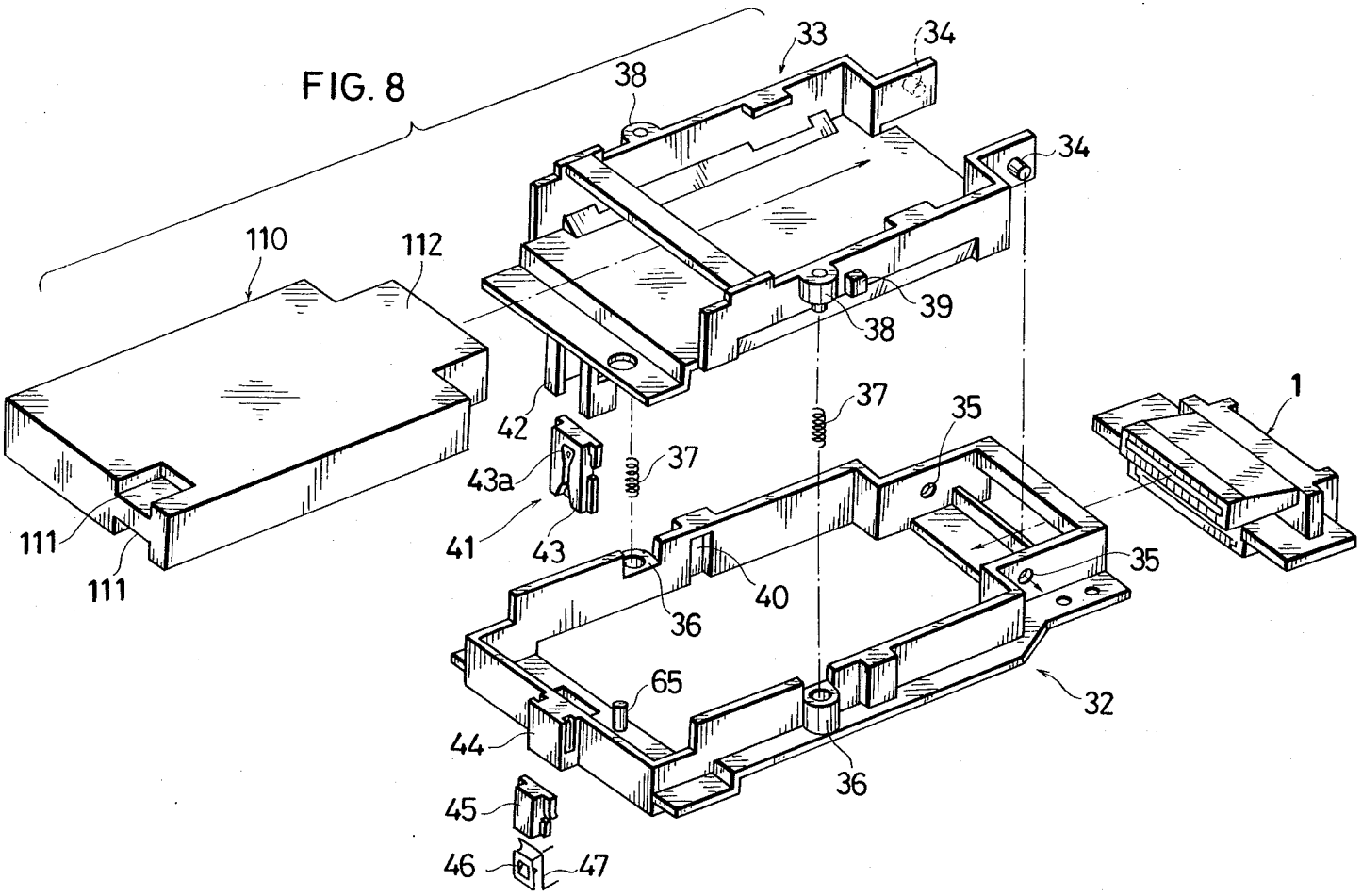
FIG. 8 is an exploded perspective view of a cassette loading/unloading device.
Figure 9:
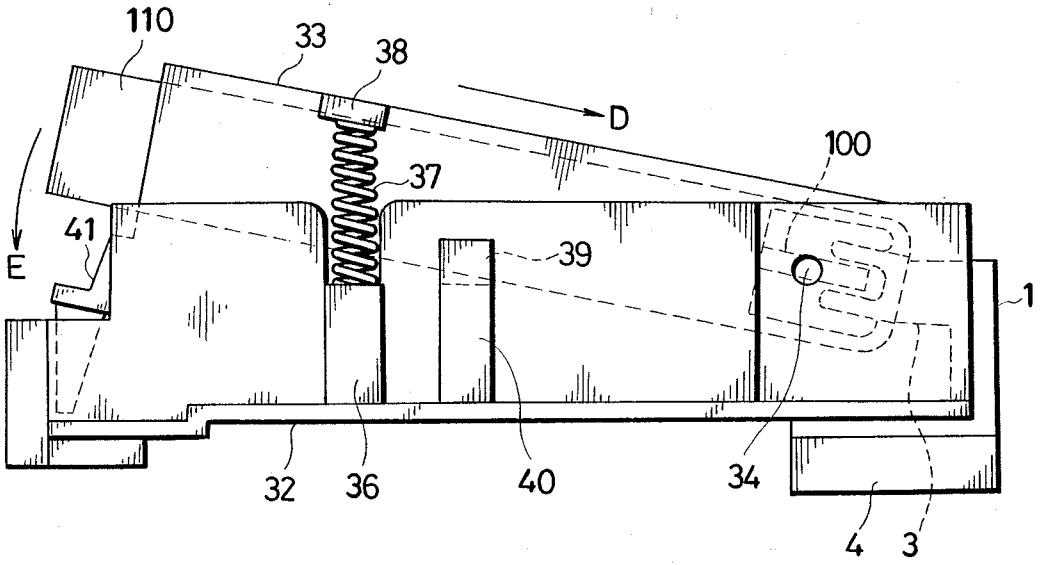
FIG. 9 is a right side view of the cassette loading/unloading device of FIG. 8.
Figure 11A:
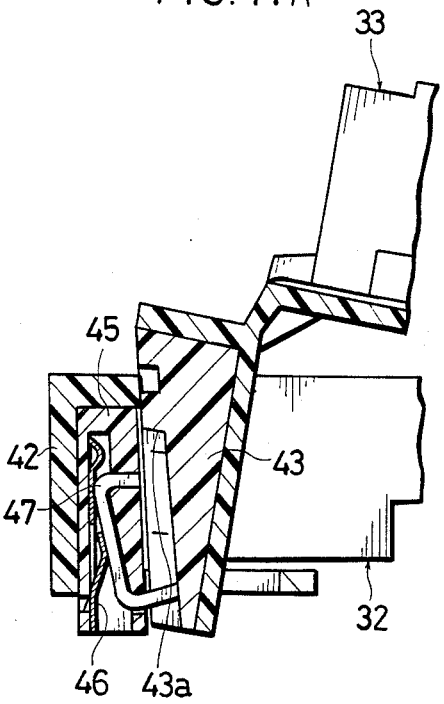
FIG. 11A is a sectional view showing the status of a locking mechanism when a tray is situated at a tilting stance.
Figure 11B:
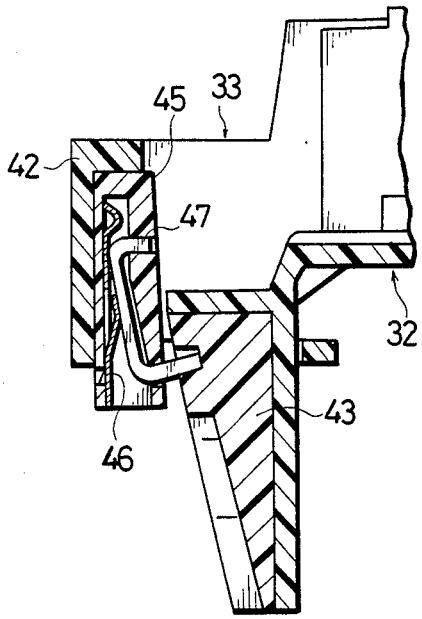
FIG. 11B is a sectional view showing the status of a locking mechanism when a tray is situated at a horizontal stance.

Referring to FIG. 8 and FIG. 9, numeral 32 denotes a frame-like holder, and numeral 33 denotes a loading tray for a cassette 110 which is rotatably loaded on the frame-like holder 32. Supporting rods 34, 34, which are equipped to be projected from both outside wall surfaces of the inner part in the inserting direction of a tray 33 are inserted into fitting holes 35, 35 on the holding frame 32 as shown by the arrow of one dot chain line in FIG. 8 so that the tray 33 is rotatable on the supporting rod 34. Up-lifting pieces 38 of the tray 33 are urged upward by coil springs 37 inserted into a pair of cylinders 36 on the holding frame 32 so that the tray 33 is supported in a specified tilting position, as shown in FIG. 9, since the upper surface of a positioning projection 39 is shifted to a position in contact with the upper surface of a positioning locking groove 40 formed on the inner surface of the holding frame 32.

Figure 10:
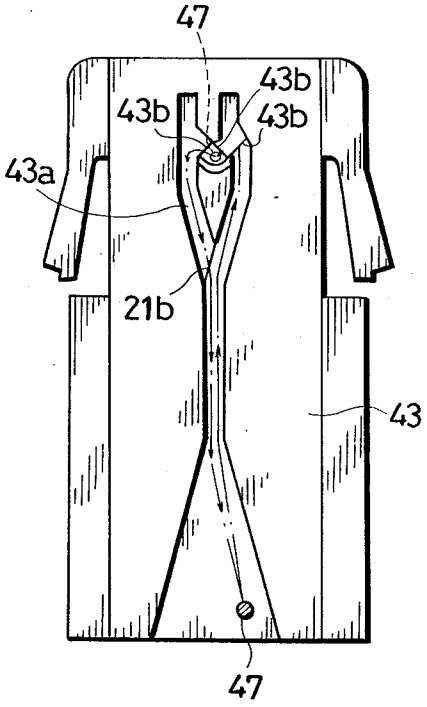
FIG. 10 is a front view of a heart cam slot of a locking mechanism.

In the front part of the tray 33 and the holding frame 32, a locking mechanism 41 is provided for locking and unlocking the tray 33 almost horizontally in the holding frame 32. As illustrated in FIGS. 8, 10, 11A and 11B, a heart cam device is used as the locking mechanism 41. The locking mechanism 41 comprises a cam plate 43 having a heart-shaped cam slot 43a engaged with a supporting frame 42 suspended from the front end of the tray 33, a holder 45 engaged with a holding frame 44 formed on the front end of the holding frame 32, a supplementary spring 46 and a cam follower pin 47 (see FIG. 11A, and FIG. 11B) which are built in the holder 45. The cam plate 43, as shown in FIG. 10, is equipped with a stepped part 43b formed at an appropriate location on cam slot 43a. The cam follower pin 47 depressed by the supplementary spring 46 on the cam slot 43a is turned in one direction as shown by the arrow of the one dot chain line so as to be position on the lower position as shown by solid line in FIG. 10 in accordance with tray 33 pushed by the coil spring 37 upward when the tray 33 is not depressed (in the position shown in FIG. 9 and FIG. 11A). When pushing down the tray 33, the follower pin 47 is moved upward along the line shown by the arrow of the one dot chain line to be locked at the upper position shown by broken line (see FIG. 11B) so that the tray 33 and the cassette 110 are held almost horizontal. When the tray 33 is lowered down again, the cam follower pin 47 is released from the locked position, returning to the original lower position along the one dot chain line.

As seen from FIG. 9, the center of oscillation of the tray 33 formed along a supporting spindle 34 of the holding frame 32 is so arranged as to be in conformity with an oscillation center P of the printed circuit board 100 when the printed circuit board 100 is removed from the tilting position to the horizontal position.

In this case, the oscillation center P of the printed circuit board 100 is so arranged as to be located on the center line between a back end corner part (a) of the retaining stopper 23 and a back end corner part (b) of the partition wall 12 provided on the bottom wall 11 of the upper body 3. In this way, when the printed circuit board 100 is moved from the tilting position to the horizontal position, the positioning is controlled by the back end corner part (a) and the upper face of the partition wall 12, and the printed circuit board 100 is held not to be swung excessively thereby preventing the contacting points 17*d*, 20*e* of the first and second upper spring contactors 17*a*, 20*a* from being twisted.

Described hereunder is a function of the cassette loading/unloading device constructed as described above.

In loading a cassette 110, when it is inserted by sliding in the direction of the arrow D in FIG. 9, one side of the printed circuit board 100 projecting into a hollow frame 112 of the cassette 110 is inserted in a space between both contacting points 17*d*, 20*e* of the female contact 24 shown in FIG. 3 in an oblique direction. In this operation, the insertion may be facilitated by grasping both of the concave parts 111 (see FIG. 8) with the fingers. As shown in FIG. 8, the inner face of the hollow frame 112 of the cassette 110 is slid and guided along the tilting upper surface of the upper side body 3 of the connector 1. Further, the side of the printed circuit board 100 is guided by a guide face 23*a* of the locking piece 23.

After the cassette 110 is inserted, when depressing the back end of the cassette 110 downward, the tray 33 rotates on the supporting shaft 34 as shown by the arrow E in FIG. 9, the cam follower pin 47 of the locking mechanism 41 slides along the cam slot 43*a* from the position shown by the solid line in FIG. 10 to be locked at the position shown by the broken line (see FIG. 11B), and thus the tray 33 and the cassette 110 have come to be supported substantially in a horizontal position. At this stage, if the cassette 110 is inserted improperly or if some other cassette except the regular one 110 happens to be inserted, a projection 65 (see FIG. 8) comes into contact with the cassette 110 so as to stop the turning movement of the cassette 110.

When the cassette 110 is taken out after the game ends, the back end part of the cassette 110 is pushed in to release the locking condition, thereby the tray 33 restores the tilting position as shown in FIG. 9 and the cassette 110 can be taken out.

The function of the connector 1 is described hereunder.

Figure 12:
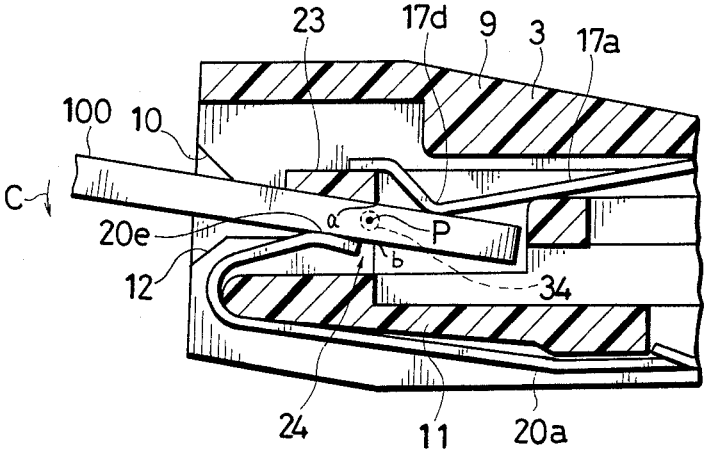
FIG. 12 gives a sectional view showing a positional relation between the center of oscillation of the printed circuit board and that of the tray.

When one side part of the printed circuit board 100 is inserted obliquely between the locking piece 23 and the partition wall 12 as shown by solid lines in FIG. 3 and FIG. 12, the first contacting point 17*d* and the second contacting point 20*e* are maintained without contact, or with a slight contact with the circuitry pattern (not shown) on one side of the printed circuit board 100. Therefore, both first and second upper spring contactor 17*a* 20*a* are not deformed so that neither friction nor peeling off is incurred on either the first and second contacting points 17*d*, 20*e* or the circuitry pattern on one side of the printed circuit board 100. When the printed circuit board 100 inserted between the first and the second contacting points 17*d*, 20*e* as mentioned above is pushed down as indicated by the arrow c to place it in a horizontal position as shown by the one dot chain line in FIG. 3, the first contacting point 17*d* is depressed by one side of the printed circuit board 100 to deform all of the first upper spring contactors 17*a* in the direction approaching the upper wall 9, and at the same time, the second contacting point 20*e* is depressed to deform all of the second upper spring contactors 20*a* in the direction separating the second upper spring contactors 20*a* from the lower face of the lower wall 11, resulting in the first and second contacting points 17*d*, 20*e* being press-contacted electrically with the circuitry pattern on one side part of the printed circuit board 100.

When the tray 33 is restored to the tilting position as shown in FIG. 9, the printed circuit board 100 is also restored to the tilting position so that the printed circuit board 100 can be taken out without contact, or if any, with a slight contact with the first and second contacting points 17*d*, 20*e*.

Consequently, in this kind of connector, as connector 1, when inserting one side of the printed circuit board 100 in and out of the female contact 24, rubbing of the first and second contacting points 17*d*, 20*e* with the circuitry pattern on one side of the print circuit board 100 is successfully avoided, and as a result, the problem of peeling off may be assuredly prevented in spite of a quite simply constructed connector. Furthermore, when the printed circuit board 100 is turned into the horizontal position, the first contacting point 17*d* is depressed by one side of the printed circuit board 100, allowing all of the upper spring contactor 17*a* to be deformed in the direction approaching to the upper wall 9, and at the same time the second contacting point 20*e* has come to be depressed so that all of the second upper spring contactors 20*a* are deformed in the direction by which the second upper spring contactors are separated from the bottom face of the lower wall 11. Accordingly, strokes of the first and second upper spring contactors 17*a*, 20*a* in their function of spring contact pieces can be extended, virtually facilitating spring pressure balance between the two spring contactors 17*a*, 20*a* and contributing considerably to enhancement in the durability and reliability of a press-fitted state between them thanks to the extended stroke of the spring contactors. Furthermore, since positioning control of the printed circuit board 100 at the time of turning to the horizontal position is exactly performed by the rear end corner portion (a) of the locking piece 23 and the upper face of the partition wall 12, there is no problem of twisting between the second upper spring contactor 20*a* and the first upper spring contactor 17*a*, and as a result durability of the spring contactors is effectively improved.

Since the laterally U-shaped portion 20*d* formed on the front end of the second upper spring contactor 20*a* by bending is coupled with the front end portion 11*a* of the lower wall 11 so that the V-shaped front end of the U-shaped portion 20*d* is projected into the inner surface of the lower wall 11, even when the front end of the U-shaped portion 20d is apt to be twisted, it is supported by the inner surface of the front end portion 11a of the lower wall 11, thus the front end of the U-shaped portion is effectively prevented from being twisted.

In addition, since the first upper spring contactor 17a can be inserted from behind the body 2 while the second upper spring contactor 20a from front of the body 2, it is possible to apply preliminarily a preload to these contactors in the direction approaching the counterpart contactors, thereby an exact press fit for good conductivity with the circuitry pattern on one side of the printed circuit board 100 is insured.

Figure 13:
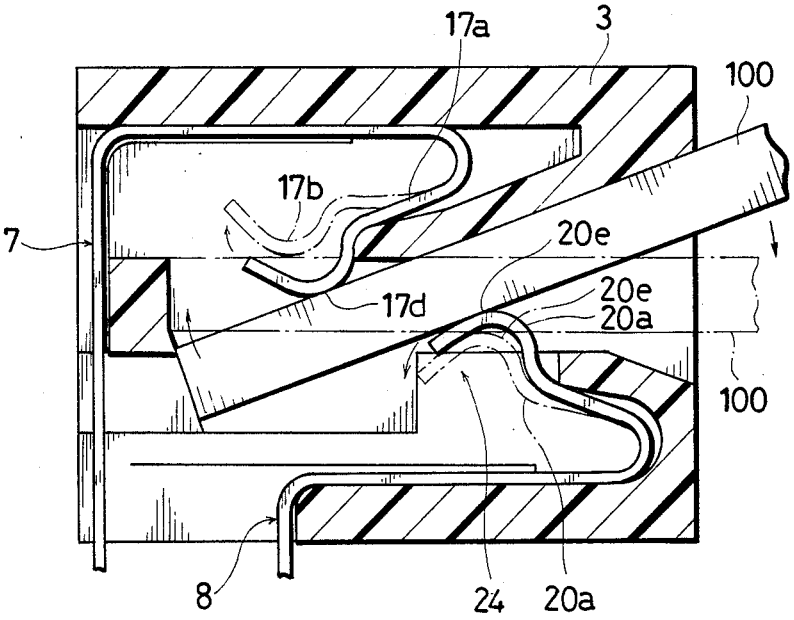
FIG. 13 is a sectional view of a connector according to another embodiment of this invention.

However, the connector according to this invention is not limited to such an embodiment. FIG. 13 illustrates another embodiment according to this invention. The connector of the second embodiment has almost the same construction as the foregoing first embodiment to insure like advantages.

In FIG. 13, like parts are designated with the same reference numerals as those shown in FIG. 3. In this embodiment, end portions of the first and second upper spring contactors 17a, 20a are folded back so as to form contacting points 17d, 20e by providing a curved portion on their front end portion respectively. The first and second contact pieces 7, 8 are so arranged as to be inserted from the back side of the body 3, respectively.

Figure 14:
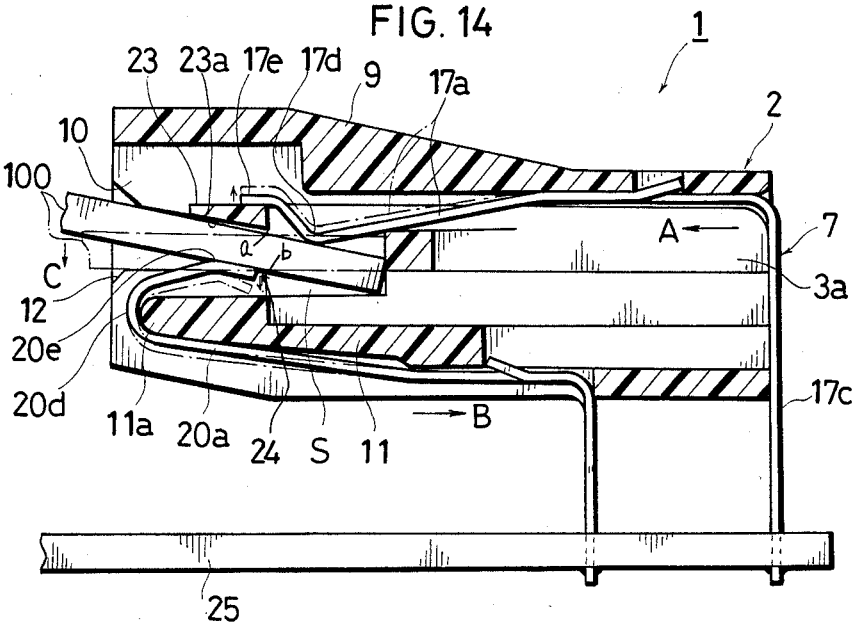
FIG. 14 is a sectional view of a connector according to a further embodiment of this invention.

There are various modifications of the connectors besides the embodiments, e.g., as that shown in FIG. 14, in which a lower body of the connector is eliminated leaving an upper body, and the end portions of the first and second contact pieces are directly connected with a main printed circuit board by soldering, etc.

Figure 15:
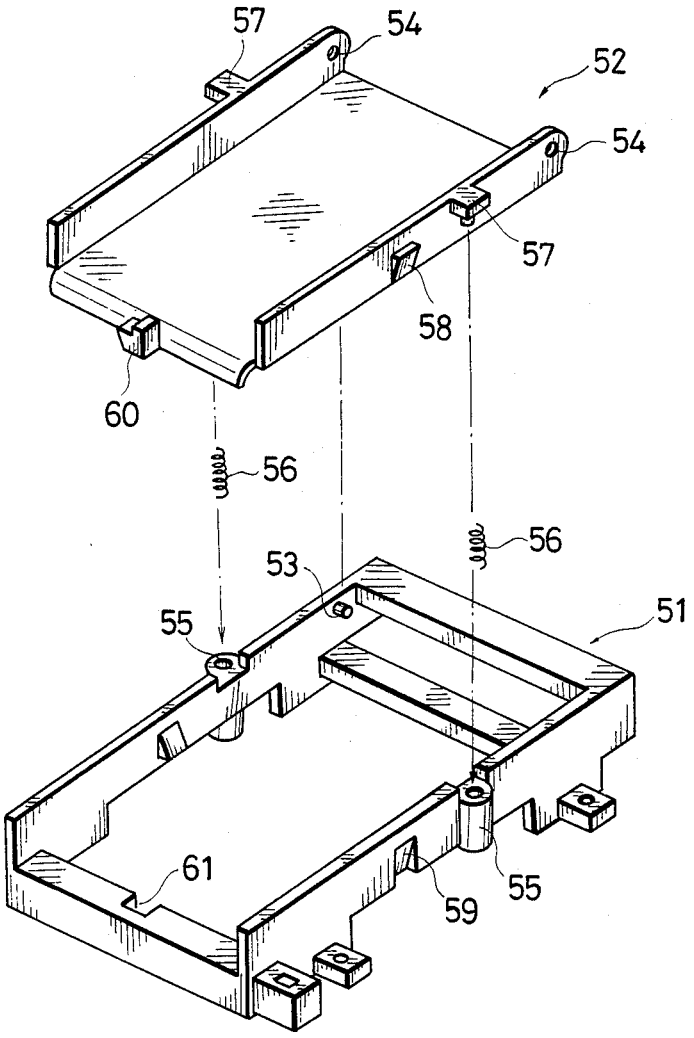
FIG. 15 is an exploded perspective view of a modification of a cassette loading/unloading device.
Figure 17:
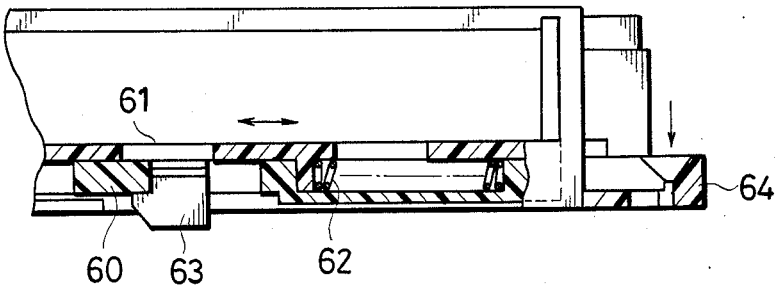
FIG. 17 gives a partially cut-out front view of a locking mechanism of the cassette loading/unloading device shown in FIG. 15.
Figure 18:
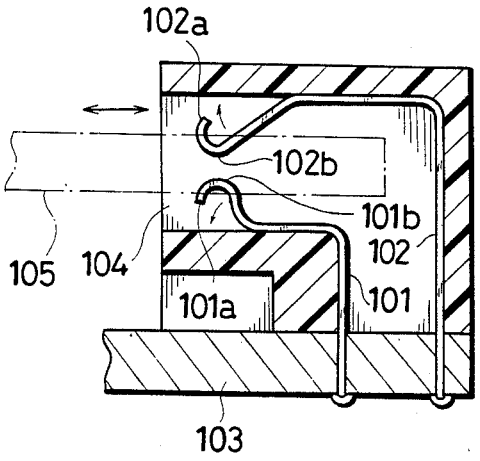
FIG. 18 is a sectional view of a conventional connector.
Figure 19:
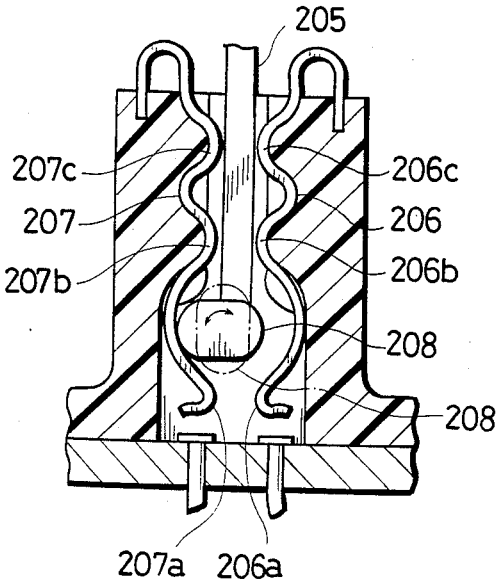
FIG. 19 is a sectional view showing another conventional connector.

Described hereunder is a modification of the cassette loading/unloading device in which a connector shown in FIG. 15 is to be inserted. This device is composed of a holding frame 51 and a tray 52 for loading a cartridge. The holding frame 51 has a supporting rod 53. This supporting rod 53 is inserted into fixing holes 54, 54 formed on the end portion of the tray 52 so that the tray 52 may be oscillatably fitted with the holding frame 51. Each of the two cylindrical parts 55 on the holding frame 51 is provided with a coil spring 56, which is brought into contact with a tongue piece 57 of the tray 52 so as to give impetus to the tray 52 invariably upwards. The tray 52 is also provided with a projection 58 to be in contact with a stopping part 59 for restricting upward motion of the tray 52. Moreover, the front part of the tray 52 is provided with a hook stopper 60 to be coupled with an opening 61 formed on the front part of the holding frame 51. As shown in FIG. 17, the opening part 61 is provided with a locking piece 63 which is invariably urged by a spring 62 so that a locking condition is established by means of the locking piece 63 being depressed by the hook stopper 60 when the hook stopper 60 is pushed into the opening 61 to jump the locking piece 63 over the hook stopper 60 for returning to the original position to be engaged with the hook stopper 60. Such a locking condition can be released by depressing a button 64 for disengagement between the locking piece 63 and the hook stopper 60.

Figure 16:
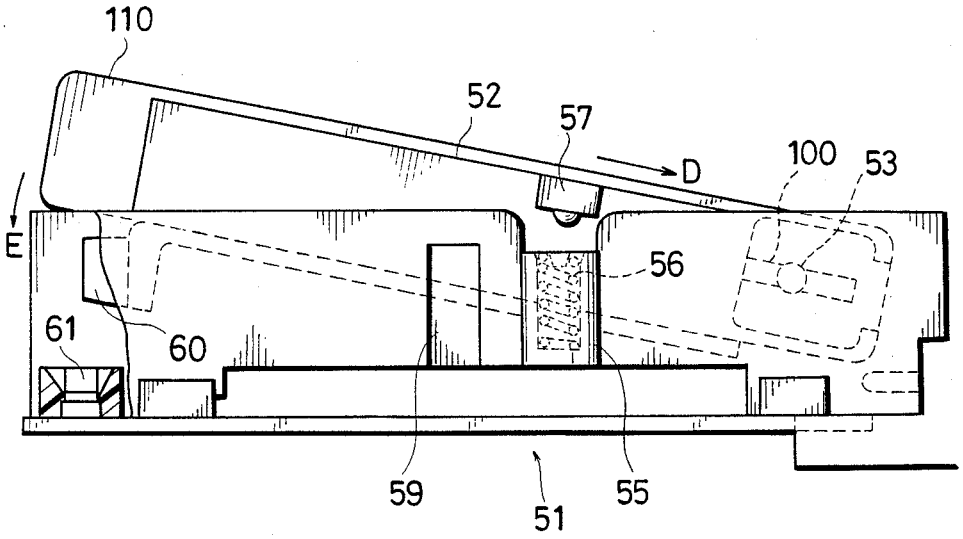
FIG. 16 is a partially cut-out right side view of the cassette loading/unloading device of FIG. 15.

As seen from FIG. 16, the center of oscillation of the tray 52 which is formed by the supporting spindle 53 of the holding frame 51 is so arranged as to be in conformity with the center of oscillation of the printed circuit board 100 when the printed circuit board 100 shown in FIG. 12 is turned from the tilting position to the horizontal position, as is the case of the cassette loading/unloading device shown in FIG. 8. In this case, the center P of oscillation of the printed circuit board 100 is so arranged as to be positioned on the center line between the back end corner (a) of the locking piece 23 and the back end corner (b) of the partition wall 12 installed on the bottom wall 11 of the upper body 3. The back end corner (a) and the upper face of the partition wall 12 function together to regulate position when moving the printed circuit board 100 from the tilting position to the horizontal position so as to prevent the contacting points 17d and 20e from being twisted in the same manner as mentioned above.

What is claimed is:

1. A connector for printed circuit boards, comprising:

a body for receiving contact pieces and printed circuit boards;

a locking piece situated within said body;

a first contact piece having a spring contactor defining a contact point; and a second contact piece having a spring contactor defining a contact point, wherein:

said first and second contact pieces being mounted to said body for receiving a printed circuit board obliquely into said body, said contact points being displaced relative to each other in said body, with respect to the direction of insertion of the printed circuit board, so that the printed circuit board is in tight contact with the contact points when the obliquely inserted printed circuit board is situated substantially horizontally;

said body having an upper wall and a lower wall partly defining a space within which the printed circuit board is received for contact with said spring contactors and within which said locking piece is situated; and the spring contactor of said first contact piece being situated near one of said walls and in contact with said locking piece and having a V-shaped portion defining the contact point of said first contact piece, and the spring contactor of said second contact piece being in contact with the outside surface of the other of said walls and having a laterally U-shaped front end with a V-shaped portion extending into said space and defining the contact point of said second contact piece.

2. The connector as defined in claim 1, further wherein:

the locking piece defines as inclined guide face serving to guide the inserted printed circuit board obliquely.

3. A connector for printed circuit boards, comprising:

a substantially laterally U-shaped body having an upper body portion, a lower body portion and a side wall joining the upper body portion and the lower body portion, said upper body portion including a spring contactor insertion slot and a rear end which is adapted to have a side of a printed circuit board inserted obliquely in and out of the rear end of the upper body portion, said lower body portion including a spring contactor insertion slot and a rear end which is adapted to have a side of another printed circuit board inserted in and out of the rear end of the lower body portion, and said side wall including an opening therein situated lengthwise thereof;

a substantially lateral U-shaped first contact piece group comprising a plurality of upper and lower spring contactors each defining a contact point, a tie bar and an equal plurality of connecting pieces connecting the tie bar to a respective upper and lower spring contactor; and a substantially lateral U-shaped second contact piece group comprising a plurality of upper and lower spring contactors each defining a contact point, a tie bar and an equal plurality of connecting pieces connecting the tie bar to a respective upper and lower spring contactor, said first contact piece group having a spacing between its upper and lower spring contactors which is greater than the spacing between the upper and lower spring contactors of the second contact piece group, wherein:

the upper and lower spring contactors of each contact piece group extend into a respective spring contact insertion slot such that the connecting pieces of each contact piece group and their associated tie bars are situated adjacent to each other at said lengthwise extending opening, and such that the contact points of the upper spring contactors of one of the contact piece groups are displaced relative to the contact points of the upper spring contactors of the other contact piece group in the spring contact insertion slot of the upper body portion with respect to the direction of insertion of the printed circuit board so that when the obliquely inserted printed circuit board is situated substantially horizontally, said printed circuit is in tight contact with the contact points of the upper spring contactors of both contact piece groups;

the upper spring contactors of the first contact piece group are V-shaped and are disposed near the inner surface of an upper wall of the upper body portion;

the upper spring contactors of the second contact piece group contact the outer surface of a lower wall of the upper body portion;

a laterally U-shaped portion of the upper spring contactors of the second contact piece group, formed on the front ends thereof, is fitted on a front end of the lower wall of the upper body portion; and a substantially inverted V-shaped front end of said U-shaped portion is disposed in the upper body portion.

4. The connector as defined in claim, 3, further wherein:

the substantially laterally U-shaped body further has a locking piece situated in the spring contactor insertion slot of the upper body portion; and the V-shaped portion of the spring contactors of the first contact piece group being held in contact with the locking piece.

5. The connector as defined in claim 4, further wherein:

the locking piece defines an inclined guide surface serving to guide the inserted printed circuit board obliquely.

* * * * *